US010227673B2

(12) United States Patent
Baumgart et al.

(10) Patent No.: US 10,227,673 B2
(45) Date of Patent: Mar. 12, 2019

(54) METHOD FOR FORMING A STEEL SHEET PART

(71) Applicant: GM GLOBAL TECHNOLOGY OPERATIONS LLC, Detroit, MI (US)

(72) Inventors: Hartmut Baumgart, Bischofsheim (DE); Ronald Sanders, Daxweiler (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 404 days.

(21) Appl. No.: 15/236,810

(22) Filed: Aug. 15, 2016

(65) Prior Publication Data

US 2016/0348209 A1 Dec. 1, 2016

Related U.S. Application Data

(62) Division of application No. 14/109,492, filed on Dec. 17, 2013, now abandoned.

(30) Foreign Application Priority Data

Dec. 17, 2012 (DE) ..... 10 2012 024 616

(51) Int. Cl.

| | |
|---|---|
| ***C21D 9/46*** | (2006.01) |
| ***C25D 3/56*** | (2006.01) |
| ***C25D 5/50*** | (2006.01) |
| ***C21D 1/06*** | (2006.01) |
| ***C21D 8/02*** | (2006.01) |
| ***C22C 18/00*** | (2006.01) |
| ***C25D 5/48*** | (2006.01) |
| *C21D 8/12* | (2006.01) |
| *C21D 1/673* | (2006.01) |
| *C25D 7/06* | (2006.01) |

(52) U.S. Cl.

CPC ..... *C21D 9/46* (2013.01); *C21D 1/06* (2013.01); *C21D 8/0247* (2013.01); *C22C 18/00* (2013.01); *C25D 3/565* (2013.01); *C25D 5/48* (2013.01); *C25D 5/50* (2013.01); *C21D 1/673* (2013.01); *C21D 8/1277* (2013.01); *C25D 7/0614* (2013.01); *Y10T 428/12799* (2015.01)

(58) Field of Classification Search

CPC ..... C21D 9/46; C21D 8/0247; C21D 1/06; C25D 3/565; C25D 5/50; C25D 5/48; C22C 18/00

See application file for complete search history.

(56) References Cited

U.S. PATENT DOCUMENTS

| | | | | |
|---|---|---|---|---|
| 4,548,868 | A | 10/1985 | Yonezawa et al. | |
| 4,659,631 | A | 4/1987 | Kurimoto et al. | |
| 5,525,431 | A | 6/1996 | Kanamaru et al. | |
| 7,832,242 | B2 | 11/2010 | Brandstatter et al. | |
| 7,938,949 | B2 | 5/2011 | Brandstatter et al. | |
| 2009/0053556 | A1 | 2/2009 | Sohn et al. | |
| 2012/0164472 | A1 | 6/2012 | Kuhn et al. | |
| 2013/0306203 | A1* | 11/2013 | Fushiwaki | C21D 9/46 148/579 |

FOREIGN PATENT DOCUMENTS

| | | | |
|---|---|---|---|
| DE | 202004021264 | U1 | 5/2007 |
| DE | 102010056265 | B3 | 5/2012 |
| EP | 0509108 | A1 | 10/1992 |
| JP | 60082691 | A | 10/1985 |

OTHER PUBLICATIONS

German Patent Office, German Search Report for German Application No. 1020120246616.1, dated Jul. 9, 2013.

* cited by examiner

*Primary Examiner* — Jessee R Roe

(74) *Attorney, Agent, or Firm* — Lorenz & Kopf, LLP

(57) ABSTRACT

A method for creating a formed steel part from a steel sheet is provided. The steel sheet is heated to austenitization temperature. The steel sheet is formed with simultaneous cooling-down. A manganese-rich surface layer of the formed steel sheet is removed.

16 Claims, 1 Drawing Sheet

METHOD FOR FORMING A STEEL SHEET PART

CROSS-REFERENCE TO RELATED APPLICATION

This application is a divisional of U.S. patent application Ser. No. 14/109,492, filed on Dec. 17, 2013, which claims priority to German Patent Application No. 10 2012 024 616.1, filed Dec. 17, 2012. Each of the above-referenced applications are incorporated herein by reference in their entirety.

TECHNICAL FIELD

The technical field relates to a method for forming a steel sheet, in particular a press-hardening steel sheet.

BACKGROUND

Press-hardening or PHS steel sheets appeared in the final years of the 20th century; from these, parts with extremely high strength can be produced by the steel sheet being heated above the austenitization temperature and through cooling down during the pressing, a substantially purely martensitic structure is obtained. It is customary to provide these steel sheets with a zinc coating as corrosion protection. Such a layer can be obtained electrogalvanically or through dipping in a zinc melt. The melting temperature of pure zinc is 420° C. and is thus low enough so as not to attack the steel during the dipping in the zinc bath and not change its crystal structure. For this reason, a corrosion protection layer on large surfaces can be quickly and cost-effectively created by dipping or hot dip galvanizing.

The boiling temperature of zinc is around 906° C. When the steel sheet is heated above the austenitization temperature, i.e. above 900° C., there is therefore the danger that the zinc layer evaporates. DE 20 2004 021 264 U1 proposes mixing the zinc layer with a small amount of an oxygen-affine element, which on the surface of the zinc layer forms an oxide skin and because of this is to prevent the evaporating of the zinc. Among the elements magnesium, silicon, titanium, calcium, aluminum, boron and manganese recommended for this, silicon, aluminum and nickel are known for forming an air-tight passivation layer on their surface, which protects underlying metal from oxidation. The exemplary embodiments described in DE 20 2004 021 264 U1 use exclusively aluminum as oxygen-affine element.

Even if through the addition of the oxygen-affine element a tight oxygen skin is actually obtained on the surface of the zinc layer, this is not able to remedy another problem that occurs during the processing of zinc-coated press-hardening metal sheets, namely the so-called liquid metal corrosion. The term stands for an entering of the liquid zinc along grain boundaries of the steel, which leads to an embrittlement of the formed parts produced from the metal sheet.

DE 20 2004 021 264 U1 also mentions the technology of "galvannealing", in which a hot dip galvanized metal sheet is heated above the melt temperature of the zinc in order to convert the zinc layer into a zinc-iron alloy layer—which is likewise effective as corrosion protection—through diffusion. Here, too, there is the danger of liquid metal corrosion.

In order to avoid embrittlement through liquid metal corrosion it has been necessary up to now to heat the steel sheet to the austenitization temperature so slowly that the surface layer of zinc can form a zinc-iron alloy layer without a molten phase occurring. The necessity of heating the steel sheet slowly leads to long cycle times and substantially impairs the productivity of the parts production from such a steel sheet.

In addition, other objects, desirable features and characteristics will become apparent from the subsequent summary and detailed description, and the appended claims, taken in conjunction with the accompanying drawings and this background.

SUMMARY

Accordingly, one of various aspects of the present disclosure is to create a steel sheet which is suitable for the production of high-strength formed steel parts with short cycle times.

In this regard, the present disclosure provides a steel sheet, in one example, a press-hardening steel sheet, having a substrate layer of steel and a corrosion protection layer containing zinc and manganese, the corrosion protection layer is electrogalvanically applied to the substrate layer and has a manganese component of at least 5% by weight. The present disclosure also provides a method for forming the steel sheet, which includes heating the steel sheet to austenitization temperature, forming the steel sheet with simultaneous cooling-down and removing a manganese-rich surface layer of the formed steel sheet.

In contrast with an aluminum addition, which has a melting point-lowering effect and retards the formation of the zinc-iron alloy layer, the addition of manganese to a zinc melt causes a substantial increase of the melting point; with a manganese component of at least 5%, the melting point is already significantly above 500° C. and thus reaches a temperature at which the forming of the alloy on the surface of the steel sheet occurs through diffusion of the zinc into the steel or of iron into the zinc. Consequently, the creation of the zinc-iron alloy layer can entirely take place in the solid phase, and the danger of liquid metal corrosion is averted.

Hot dip galvanizing is not an option for producing the metal sheet according to the present disclosure, since a Zn—Mn-bath used for this would have to have such a high temperature that the zinc-iron alloy layer would already start forming during dip galvanizing and changes to the crystal structure of the steel could occur. For this reason, it is provided according to the various teachings of the present disclosure to apply the corrosion protection layer of Zn and Mn electrogalvanically.

The melting point increase of the corrosion protection layer caused through the manganese addition simultaneously causes a reduction of the temperature range, in which the corrosion protection layer during the heating to austenitization temperature can be in the liquid form and because of this reduces the risk of unintentional melting of the layer. In this way, the heating-up time of the austenitization treatment compared with that needed for a formed part provided with a low-melting zinc layer can be shortened by about one to two minutes.

In principle, a manganese component of at least 5% by weight is sufficient in order to be able to heat the steel sheet so high that the zinc diffuses, forming the already mentioned zinc-iron alloy layer. A higher component of manganese however makes possible a more rapid heating-up, since a higher temperature can be reached without the corrosion protection layer melting, and at this higher temperature the diffusion of the zinc occurs more rapidly.

For this reason, in one example, a manganese component of the corrosion protection layer is at least 8% by weight, and in another example, the manganese component of the corrosion protection layer is above about 15% by weight.

The manganese component should generally not exceed about 25% by weight, for the melting point increase that can be reached through an even higher manganese component no longer has any benefit when before reaching of the melting temperature the diffusion of the zinc into the steel surface has already taken place. At the most, higher manganese components then additionally bring about an increase of the scale layer which forms on the metal sheet during the heat treatment and which should be removed before the formed part produced from the metal sheet is welded, glued or otherwise further processed.

Also provided according to various embodiments is the formed part obtained from the above described steel sheet through heating and forming with simultaneous cooling-down.

Generally, the corrosion layer of such a formed steel part comprises a manganese-rich surface layer and a manganese-depleted substrate. By removing the largely oxidic surface layer, a formed steel part can be obtained whose exposed surface substantially only consists of the manganese-depleted substrate and which possesses the known good corrosion protection effect of a zinc-iron alloy.

Also provided according to various embodiments is a method for creating a formed steel part from a steel sheet of the type described above with the steps. In one example, the method includes heating the steel sheet to austenitization temperature; forming the steel sheet with simultaneous cooling-down; and removing a manganese-rich surface layer of the formed steel sheet.

A person skilled in the art can gather other characteristics and advantages of the disclosure from the following description of exemplary embodiments that refers to the attached drawings, wherein the described exemplary embodiments should not be interpreted in a restrictive sense.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
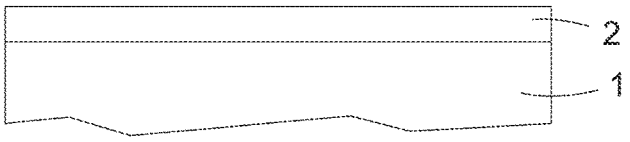
FIG. 1 is a schematic section through a steel sheet according to the various teachings of the present disclosure.

FIG. 1 shows a section through a PHS steel sheet according to the present disclosure. On a substrate 1 of steel, a primary corrosion protection layer 2 of zinc and at least 5%, or at least 8% by weight of manganese is electrogalvanically deposited. The thickness of the primary corrosion protection layer 2 typically is between about 10 and about 50 μm.

Figure 2:
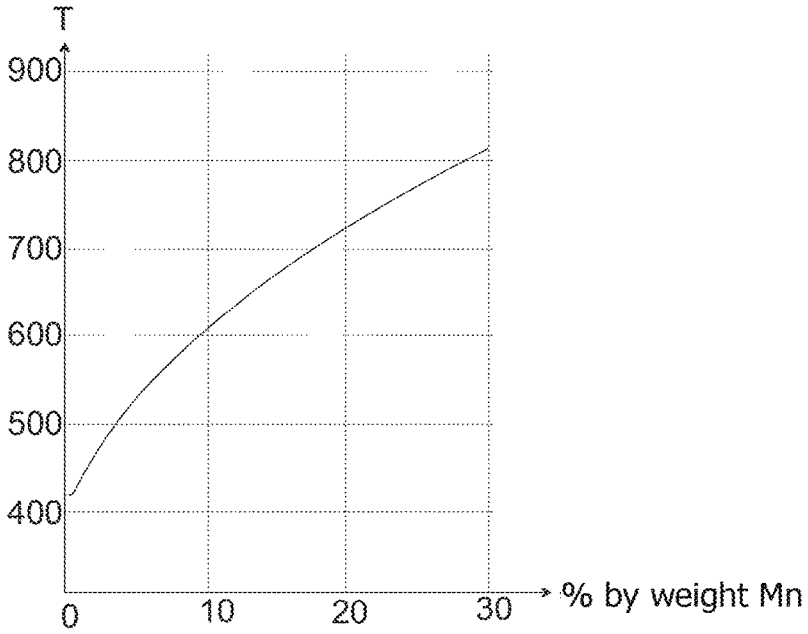
FIG. 2 is a graphic representation of the relationship between melting temperature and manganese content of a zinc-manganese alloy.

The graph of FIG. 2 shows the melting temperature of a zinc-manganese alloy as a function of its manganese content. The melting point of pure zinc is 420° C. Even a manganese component of about 5% by weight is sufficient in order to achieve a melting temperature of above 500° C., i.e. a temperature range, in which diffusion occurs on an iron-zinc interface and a zinc-iron alloy is created. A manganese addition of about 5% by weight is thus sufficient in order to have such an alloy formation take place without liquefaction of the zinc in the meantime.

Figure 3:
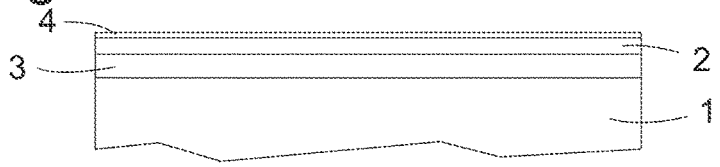
FIG. 3 is a section through a formed part obtained from the steel sheet of FIG. 1 immediately after press-hardening.

With increasing manganese component the melting point rises further; with a component of about 10% by weight, it is just above 600° C. The steel sheet shown in FIG. 1 could thus be suddenly heated to this temperature without the primary corrosion protection layer 2 melting. The time required in practice for heating to this temperature is sufficient in order to form a Zn—Fe alloy layer as secondary corrosion protection layer 3 on the boundary between steel substrate 1 and corrosion protection layer 2, as shown in FIG. 3, which completely consumes the primary corrosion protection layer 2 or, in the case that the primary corrosion protection layer 2 is strong enough or the temperature increase is so rapid that a liquefaction of the primary corrosion protection layer 2 nevertheless still occurs, protects the steel substrate 1 from direct contact with it.

At a manganese component of about 15% by weight, a melting point of approximately 670° C. is reached. The protection from an attack of the steel substrate 1 through liquid zinc at high temperature or the speed of the diffusion, through which the Zn—Fe alloy layer 3 is created without liquifaction, is even further increased here.

Since the melting point of manganese is above the austenitization temperature of the steel sheet of approximately 900° C. melting of the corrosion protection layer 2 through an even higher manganese component could be completely excluded during the austenitization treatment. However, because of the formation of the zinc-iron diffusion layer described above, this is neither necessary nor desirable for the diffusion does not only result in zinc from the primary corrosion protection layer 2 entering the steel substrate 1 and iron from the steel substrate 1 entering the primary corrosion protection layer 2, but also in a migration of the manganese out of the primary corrosion protection layer 2 to the surface of the metal sheet, where it oxidizes through atmospheric oxygen and remains bound because of this. The surface of the metal sheet thus forms a depression to which the manganese migrates to be sure, but from which no diffusion back into the primary corrosion protection layer 2 takes place. Instead, an oxide layer 4 with a high manganese component is created on the surface of the metal sheet, while the manganese component of the secondary corrosion protection layer 3 and, provided it is not completely consumed during the formation of the secondary corrosion protection layer 3, of the primary corrosion protection layer 2 is lower than that of the corrosion protection layer 2 prior to the austenitization treatment.

The layer structure of steel substrate 1, secondary corrosion protection layer 3, any remaining but substantially completely manganese-depleted primary corrosion protection layer 2 and oxide layer 4 is retained when a formed part is press-formed from the metal sheet. By the press-forming of the metal sheet taking place with simultaneous cooling-down, the steel substrate 1 is given a substantially purely martensitic structure of maximum strength.

Figure 4:
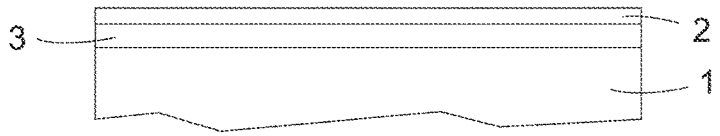
FIG. 4 is a section through the formed part in a state ready for further processing.

Through sandblasting or another suitable surface treatment, the oxide layer 4 is removed from the finished formed part as shown in FIG. 4 in order to obtain a clean metallic surface, which is suitable for welding, gluing, painting or other processing. This metallic surface according to the representation of FIG. 4 can be formed by the remaining primary corrosion protection layer 2 and/or by the secondary corrosion protection layer 3. The manganese originally contained in the primary corrosion protection layer 2 electrogalvanically deposited on the steel substrate 1 has practically been removed completely through the removal of the oxide layer 4, so that the chemical composition of the layers 2, 3 of the finished formed part do not substantially differ from that of a conventional PHS steel sheet with substantially manganese-free hot dip galvanized layer. The speed with which the steel sheet can be heated during the austenitization treatment however makes possible producing the formed parts with a significantly shortened clock speed and accordingly better economy.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. A method for creating a formed steel part from a steel sheet, comprising:

heating the steel sheet to austenitization temperature;

forming the steel sheet with simultaneous cooling-down; and removing a manganese-rich surface layer of the formed steel sheet.

2. The method of claim 1, wherein the steel sheet includes a steel substrate layer and a corrosion protection layer containing zinc and manganese.

3. The method of claim 2, further comprising electrogalvanically applying the corrosion protection layer to the steel substrate layer prior to heating the steel sheet to austenitization temperature, the corrosion protection layer having a manganese component of at least 5% by weight.

4. The method of claim 2, wherein the manganese component of the corrosion protection layer is at least 8% by weight.

5. The method of claim 2, wherein the manganese component of the corrosion protection layer maximally amounts to 25% by weight.

6. The method of claim 2, wherein the heating the steel sheet further comprises:

forming a second corrosion protection layer on a boundary between the steel substrate layer and a manganese-depleted layer of the corrosion protection layer; and forming the manganese-rich surface layer along the manganese-depleted layer such that an exterior surface of the steel sheet consists of the manganese-rich surface layer.

7. The method of claim 6, wherein the second corrosion protection layer comprises a zinc-iron alloy layer between the steel substrate layer and the manganese-depleted layer.

8. The method of claim 7, wherein the removing the manganese-rich surface layer of the formed steel sheet further comprises removing the manganese-rich surface layer of the corrosion protection layer such that an exposed surface of the formed steel sheet consists of the manganese-depleted layer.

9. The method of claim 1, wherein forming the steel sheet with simultaneous cooling-down further comprises press-hardening the steel sheet into a formed part with the simultaneous cooling-down.

10. The method of claim 2, wherein the removing the manganese-rich surface layer of the formed steel sheet further comprises removing the manganese-rich surface layer such that the manganese contained in the corrosion protection layer electrogalvanically deposited onto the steel substrate layer has been substantially removed.

11. A method for creating a formed steel part from a steel sheet, comprising:

electrogalvanically applying a corrosion protection layer to a steel substrate layer to form the steel sheet, the corrosion protection layer having a manganese component of at least 5% by weight;

heating the steel sheet to austenitization temperature to form a manganese-rich surface layer;

forming the steel sheet with simultaneous cooling-down; and removing the manganese-rich surface layer of the formed steel sheet.

12. The method of claim 11, wherein the heating the steel sheet further comprises:

forming a second corrosion protection layer on a boundary between the steel substrate layer and a manganese-depleted layer of the corrosion protection layer; and forming the manganese-rich surface layer along the manganese-depleted layer such that an exterior surface of the steel sheet consists of the manganese-rich surface layer.

13. The method of claim 12, wherein the second corrosion protection layer comprises a zinc-iron alloy layer between the steel substrate layer and the manganese-depleted layer.

14. The method of claim 13, wherein the removing the manganese-rich surface layer of the formed steel sheet further comprises removing the manganese-rich surface layer of the corrosion protection layer such that an exposed surface of the formed steel sheet consists of the manganese-depleted layer.

15. The method of claim 11, wherein the heating the steel sheet further comprises:

forming a second corrosion protection layer on a boundary between the steel substrate layer and the corrosion protection layer, wherein the second corrosion protection layer comprises a zinc-iron alloy layer between the steel substrate layer and the corrosion protection layer.

16. A method for creating a formed steel part from a steel sheet, consisting of:

electrogalvanically applying a corrosion protection layer to a steel substrate layer to form the steel sheet, the corrosion protection layer having a manganese component of at least 5% by weight;

heating the steel sheet to austenitization temperature to form a manganese-rich surface layer and a manganese-depleted layer under the manganese-rich surface layer;

forming the steel sheet with simultaneous cooling-down; and removing the manganese-rich surface layer of the formed steel sheet such that an exposed surface of the formed steel sheet consists of the manganese-depleted layer.

* * * * *